US008813689B2

(12) United States Patent
Claussen et al.

(10) Patent No.: US 8,813,689 B2
(45) Date of Patent: Aug. 26, 2014

(54) RADIAL FAN AND A HIGH-PRESSURE CLEANING DEVICE HAVING A RADIAL FAN

(75) Inventors: Ernst Claussen, Steinfeld (DE); Joachim Peetz, Ascheffel (DE); Gerd Wegner, Eckernförde (DE); Ralph Seitter, Backnang (DE); Lutz Bauer, Spiegelberg (DE)

(73) Assignees: Punker GmbH, Eckernforde (DE); Alfred Karchner GmbH & Co. KG, Winnenden (DE)

( * ) Notice: Subject to any disclaimer, the term of this patent is extended or adjusted under 35 U.S.C. 154(b) by 1458 days.

(21) Appl. No.: 12/521,531

(22) PCT Filed: Nov. 13, 2007

(86) PCT No.: PCT/EP2007/009787

§ 371 (c)(1),
(2), (4) Date: Nov. 8, 2010

(87) PCT Pub. No.: WO2008/083787

PCT Pub. Date: Jul. 17, 2008

(65) Prior Publication Data

US 2011/0044808 A1 Feb. 24, 2011

(30) Foreign Application Priority Data

Dec. 28, 2006 (DE) ..... 10 2006 061 756

(51) Int. Cl.
*F22B 33/16* (2006.01)

(52) U.S. Cl.
USPC ..... 122/235.29; 122/38; 415/211.2; 417/423.14

(58) Field of Classification Search
USPC ..... 122/5.51, 38, 235.29, 411; 415/119, 415/211.1, 211.2, 206; 417/312, 313, 417/423.9, 423.14, 423.2
See application file for complete search history.

(56) References Cited

U.S. PATENT DOCUMENTS

| | | | | |
|---|---|---|---|---|
| 4,011,904 | A * | 3/1977 | Hope et al. | 165/108 |
| 4,232,634 | A * | 11/1980 | Terrell et al. | 122/41 |
| 4,480,967 | A | 11/1984 | Schulze | |
| 6,468,053 | B2 * | 10/2002 | Wolpert | 417/312 |
| 2001/0005482 | A1 * | 6/2001 | Wolpert | 417/234 |
| 2009/0308332 | A1 * | 12/2009 | Tanbour | 122/14.2 |

FOREIGN PATENT DOCUMENTS

| | | | |
|---|---|---|---|
| DE | 30 01 571 | A1 | 7/1981 |
| DE | 31 15 698 | C1 | 12/1982 |
| DE | 298 20 766 | U1 | 11/1998 |
| EP | 0 248 282 | B1 | 12/1987 |
| EP | 0 616 132 | A1 | 9/1994 |
| EP | 1 002 958 | A2 | 5/2000 |
| EP | 1 022 469 | B1 | 7/2000 |

* cited by examiner

*Primary Examiner* — Gregory A Wilson
(74) *Attorney, Agent, or Firm* — Browdy and Neimark, PLLC

(57) ABSTRACT

A centrifugal fan with a pot-like impeller and with a housing, having a first circumferential wall region with an arc-like curvature which extends directly along the impeller. The housing includes in a direction of rotation of the impeller a second circumferential region with a radial distance from the impeller increasing spirally up to an outlet region. The housing includes in an opposite direction a third circumferential wall region extending to the outlet region, having an S-curvature and including a sub-region curved in the same direction as the first circumferential wall region forming a flow baffle element. Two side walls cover the axial end faces of the impeller wherein one of the side walls extends into the pot-like impeller and divides its interior into a first suction chamber having an intake and a second suction chamber. The outlet region expands in cross-section in the outlet flow direction.

9 Claims, 3 Drawing Sheets

RADIAL FAN AND A HIGH-PRESSURE CLEANING DEVICE HAVING A RADIAL FAN

BACKGROUND

The invention relates to a centrifugal fan designed as a so-called HG fan with a pot-like impeller provided with a blade ring at its circumference, with a housing accommodating the impeller, a circumferential wall of which, starting from a first circumferential wall region with an arc-like curvature which extends directly along the blade ring, comprises on the one hand in the direction of rotation of the impeller a second circumferential region with a radial distance from the impeller increasing spirally up to an outlet region and on the other hand against the direction of rotation of the impeller a third circumferential wall region likewise extending to the outlet region, with two side walls covering the axial end faces of the impeller, wherein a partition on one of the side walls extends into the pot-shaped impeller and divides its interior into a first and a second suction chamber, and wherein the first suction chamber has an intake and the second suction chamber is adjacent to the first circumferential wall region which directly extends along the blade ring.

BACKGROUND

A centrifugal fan of this type as known for example from EP 1022469 B1 is capable of developing relatively high static pressures and has a good P/V characteristic, but cost and space considerations invariably demand a reduction in overall size and an increase in pressure and volumetric flow rate. In many applications, it is not possible to increase the fan speed in order to obtain these improvements; this applies for example to high-pressure cleaning apparatus in which one drive motor drives both a centrifugal fan and a high-pressure pump. High-pressure pumps are usually operated at speeds below 1500 rpm, forcing the centrifugal fan to operate at the same speed unless expensive and complex gearing is provided.

A high-pressure cleaning apparatus known from EP 0248282 B1 comprises such a pump and fan assembly with a drive shaft. To produce the required combustion air in an apparatus of this type, either a very high-volume centrifugal fan has to be used, or the speed has to be increased significantly, or a correspondingly smaller burner which requires less combustion air has to be installed.

Pump and fan assemblies with a drive shaft are also known from DE 3001571 A1 and DE 3115698 C1.

SUMMARY

The invention is based on the problem of so improving a centrifugal fan in HG technology in terms of volumetric flow rate and pressure, in particular for application in a high-pressure cleaning apparatus, that a less voluminous design is obtained and/or operation at lower speeds becomes possible.

According to the invention, this problem is solved by a centrifugal fan with a pot-like impeller provided with a blade ring at its circumference, with a housing accommodating the impeller, a circumferential wall of which, starting from a first circumferential wall region with an arc-like curvature which extends directly along the blade ring, comprises on the one hand in the direction of rotation of the impeller a second circumferential region with a radial distance from the impeller increasing spirally up to an outlet region and on the other hand against the direction of rotation of the impeller a third circumferential wall region likewise extending to the outlet region, with two side walls covering the axial end faces of the impeller, wherein a partition on one of the side walls extends into the pot-shaped impeller and divides its interior into a first and a second suction chamber, and wherein the first suction chamber has an intake and the second suction chamber is adjacent to the first circumferential wall region which directly extends along the blade ring.

The centrifugal fan according to the invention in particular offers the advantage that the S-shaped circumferential wall region guides and improves the return flow to the second suction chamber in the manner of a flow baffle element, resulting in an overall increase in the performance of the fan. In addition, the outlet region increasing in cross-section in the manner of a diffuser likewise increases the power of the fan. This outlet region is integrated into or with the centrifugal fan. The improved performance data make the centrifugal fan particularly suitable for high-pressure cleaning apparatus, where a small-volume design combined with a relatively low speed is required. This low speed is not only required in view of the joint operation with a high-pressure pump, but it also contributes to a reduction in noise emission. At the same time, the service life of the centrifugal fan and of any high-pressure pump which may be mounted on the same drive shaft is increased.

The measures listed in the dependent claims result in advantageous further developments of and improvements to the centrifugal fan as claimed.

In an advantageous way, the end regions of the second and third circumferential wall regions which are remote from the impeller form opposite wall regions of the outlet region, so that the latter is completely integrated without any transition. This also results in an improvement in flow conditions.

At its start on the housing side, the outlet region has its smallest width, which is preferably less than half of the diameter of the impeller. This dimensioning has proved to be particularly expedient in obtaining a high pressure and a high volumetric flow rate. This is expediently achieved by providing that the third circumferential wall region has a shape oriented towards the interior of the housing in the manner of a tongue at the housing-side start of the outlet region, so that this restriction at the start of the outlet region is obtained by means of the circumferential wall regions and no additional elements are required.

The housing is preferably made of plastic for simple and cost-effective production, but a metal housing is a feasible alternative in principle.

In a preferred embodiment, the second circumferential wall region has a logarithmic spiral shape which has proved to be advantageous in terms of the objectives aimed at.

Another contribution to the improvement of the desired properties of the assembly is made by a labyrinth sealing system formed between the impeller or its blade ring and the two side walls.

In view of the characteristics and advantages described above, the centrifugal fan according to the invention is particularly suitable for use in a high-pressure cleaning apparatus wherein the impeller of the centrifugal fan and a high-pressure pump are mounted on one and the same drive shaft of a drive motor and form a pump and fan assembly. In a preferred design, the centrifugal fan is located on one side of the drive motor while the high-pressure pump is located on the other side.

In an advantageous design development, the pump and fan assembly is mounted on an in particular mobile chassis together with a boiler, the centrifugal fan being connected to the boiler to supply combustion air for a burner, and a fluid line extending from the high-pressure pump for heating the fluid in the boiler.

BRIEF DESCRIPTION OF THE DRAWINGS

An embodiment of the invention is illustrated in the drawing and explained in greater detail in the following description. Of the drawing.

DETAILED DESCRIPTION OF THE DRAWINGS

Figure 1:
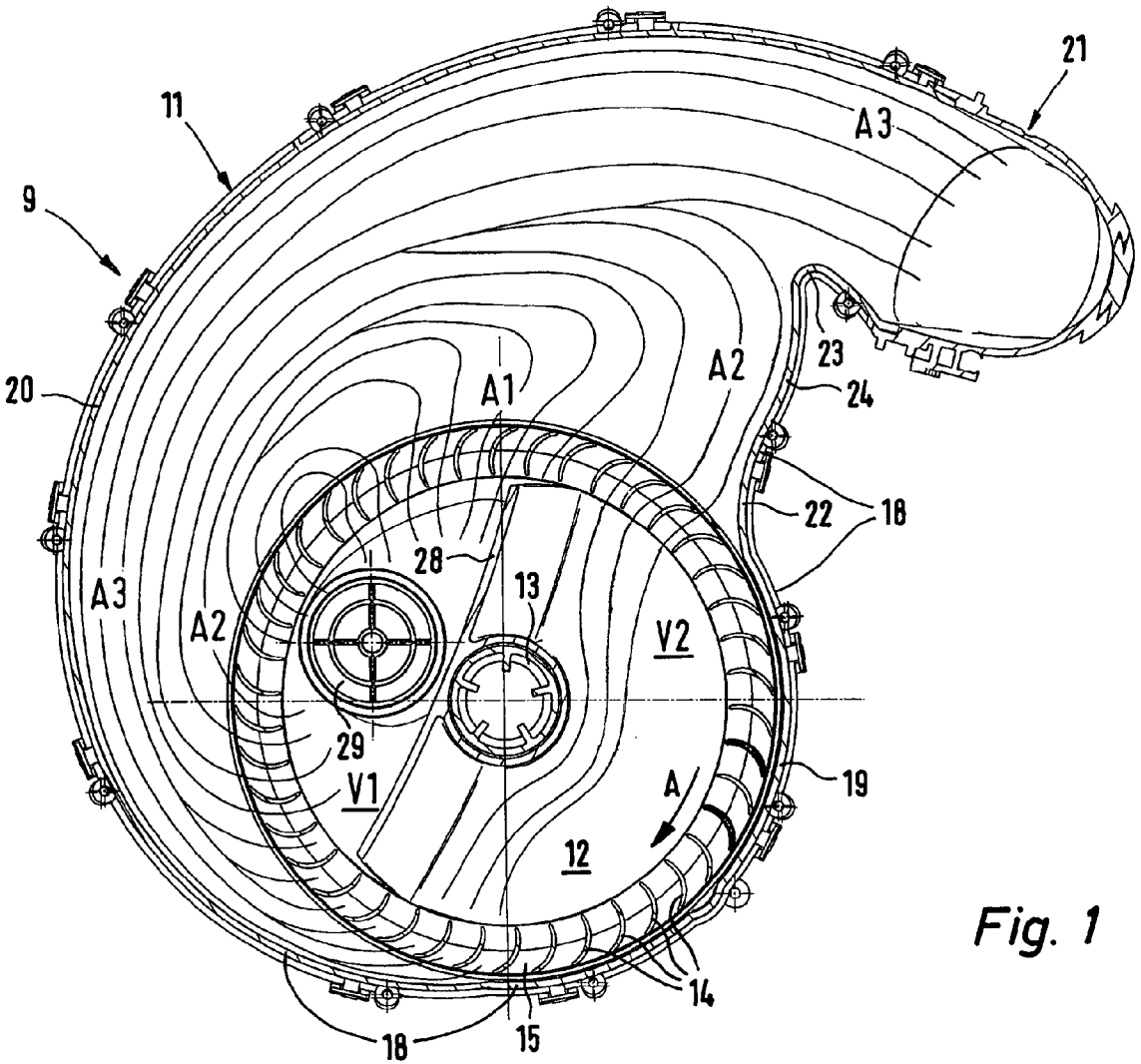
FIG. 1 is a side view of the centrifugal fan in an embodiment according to the invention, wherein the side wall provided with the partition has been removed, while the partition is shown.

In the embodiment of a centrifugal fan 9 shown in FIG. 1, a pot-like impeller 10 is rotatably installed into a volute-like housing 11. The impeller 10 has a circular disc-shaped base 12 provided in the center with a hub 13 for connection to the drive shaft 16 of a drive motor 17 which is only shown in FIG. 3. In the radially outer circumferential region of the base 12, a plurality of blades 14 forming a blade ring 15 extends at right angles to its plane.

The housing 11 comprises a volute-like circumferential wall 18, with a first circumferential wall region 19 with a circular arc-like curvature extending with a very small gap directly along the blade ring 15, covering an angle of approximately 120.degree. in the illustrated embodiment. This angle may vary, and a sealing arrangement in the manner of a labyrinth seal may be provided between the blade ring 15 and the first circumferential wall region 19.

The rear end of the first circumferential wall region 19 as viewed in relation to the direction of rotation A of the impeller 10 adjoins a second circumferential wall region 20 extending spirally to an outlet region 21 forming the fan outlet, its distance from the impeller 10 increasing gradually. The second circumferential wall region 20 has a logarithmic spiral shape.

In the opposite direction, the first circumferential wall region 19 is adjoined by a third circumferential wall region 22 which likewise extends to the outlet region 21. This third circumferential wall region 22 is S-shaped as far as a tongue-like indentation 23, the indentation 23 forming the start of the outlet region 21, which at this point has its smallest width relative to the direction of discharge flow and then expands in width and cross-section in the direction of discharge flow in the manner of a diffuser. The two end regions of the second circumferential wall region 20 and the third circumferential wall region 22 which are remote from the first circumferential wall region 19 form opposite walls of the outlet region 21, which is thereby made integral with the circumferential wall 18. In an alternative embodiment, it may be attached thereto.

Starting from the first circumferential wall region 19, the S-curvature of the third circumferential wall section 22 runs first in the opposite direction and then in the same direction. The curvature section 24 running in the same direction (as the first circumferential wall region 19) forms a flow baffle element for the part-flow returned to the impeller 10. The indentation 23 promotes the division of the flow into this returned part-flow and the part-flow reaching the outlet region 21.

The circumferential wall 18 together with the two side walls 25, 26 covering the open sides of the circumferential wall 18 forms the housing 11. According to FIG. 3, these side walls 25, 26 are integrated with an axial sub-region of the circumferential wall 18, resulting in a two-part housing 11. The two parts are bolted to one another along a joint line 27 or attached to one another by some other means.

As an alternative, the circumferential wall 18 can obviously be completely integrated with one of the two side walls 25, 26, or the housing may comprise three parts, these being the circumferential wall 18 and the two side walls 25, 26.

The impeller 10 is sealed against the two side walls 25, 26 by means of a labyrinth arrangement as described in greater detail in EP 1022469 B1 or EP 1022470 B1.

From the side wall 26 (not shown in FIG. 1), a partition 28 extends into the interior of the pot-like impeller 10 and divides its interior into a first suction chamber V1 and a second suction chamber V2 facing the circumferential wall region 19. This partition 28 extends at an angle from the side wall 26 to the base 12 of the impeller 10, but in principle it may extend parallel to the axis of rotation of the impeller 10. To seal the gap between the base 12 of the impeller 10 and the edge of the partition 28 which faces this base 12, this edge may be provided with sealing elements as described in greater detail in the cited prior art. The side wall 26 has an air intake 29 terminating in the first suction chamber V1.

The air intake 29 may be designed in various shapes and configurations. Various variants and developments are described in greater detail in the cited prior art and can be used in the context of the present invention.

The operating principles are described in detail in the cited prior art according to EP 1022469 B1 or EP 1022470 B1 and are therefore described below in a simplified and abridged manner. They are based on a tailor-made combination of centrifugal and crossflow fan technology with side-channel compressor technology which is described as HG technology. Depending on configuration, one or the other of these technologies predominates.

If the impeller 10 rotates in direction A, the impeller 10 acts as a centrifugal fan in the region of the first suction chamber V1. Ambient air is drawn into the first suction chamber V1 through the air intake 28 and accelerated radially outwards over the circumferential region of the first suction chamber V1 by the blade ring 15. On the outside, this accelerated air flow is split into an operating flow A1 and an operating flow A2. The operating flow A1 is returned into the first suction chamber V1 and is once again accelerated towards the outside by the centrifugal fan action, a substantial part of this operating flow reaching the spirally expanding region at the opposite end of the first suction chamber V1.

In the region of the second suction chamber V2, the impeller is not enclosed by the side walls 25, 26 at its two axial end faces. Towards the interior, the partition 28 provides a tight seal, and in the first circumferential wall region 19 opposite the partition, the partition itself provides the seal. As a result, the impeller 10 operates exclusively as a crossflow fan in the region of the second suction chamber V2, drawing in the operating flow A2 with the support of the S-curvature of the third circumferential wall region 22 and the indentation 23. This operating flow A2 is then compressed and again discharged on the opposite side of the impeller 10. The fan therefore acts in part as a two-stage fan, with one stage represented by the first suction chamber V1 acting as a centrifugal fan and a second stage represented by the second suction chamber V2 acting as a crossflow fan.

The third operating flow A3 emerging from the second stage, i.e. from the suction chamber V2, then reaches the outlet region 21 along the spirally curved second circumferential wall region 20.

The design of the outlet region 21 as an exhaust diffuser with the expanded width or cross-section as described above results in an increase of the static fan pressure.

Figure 2:
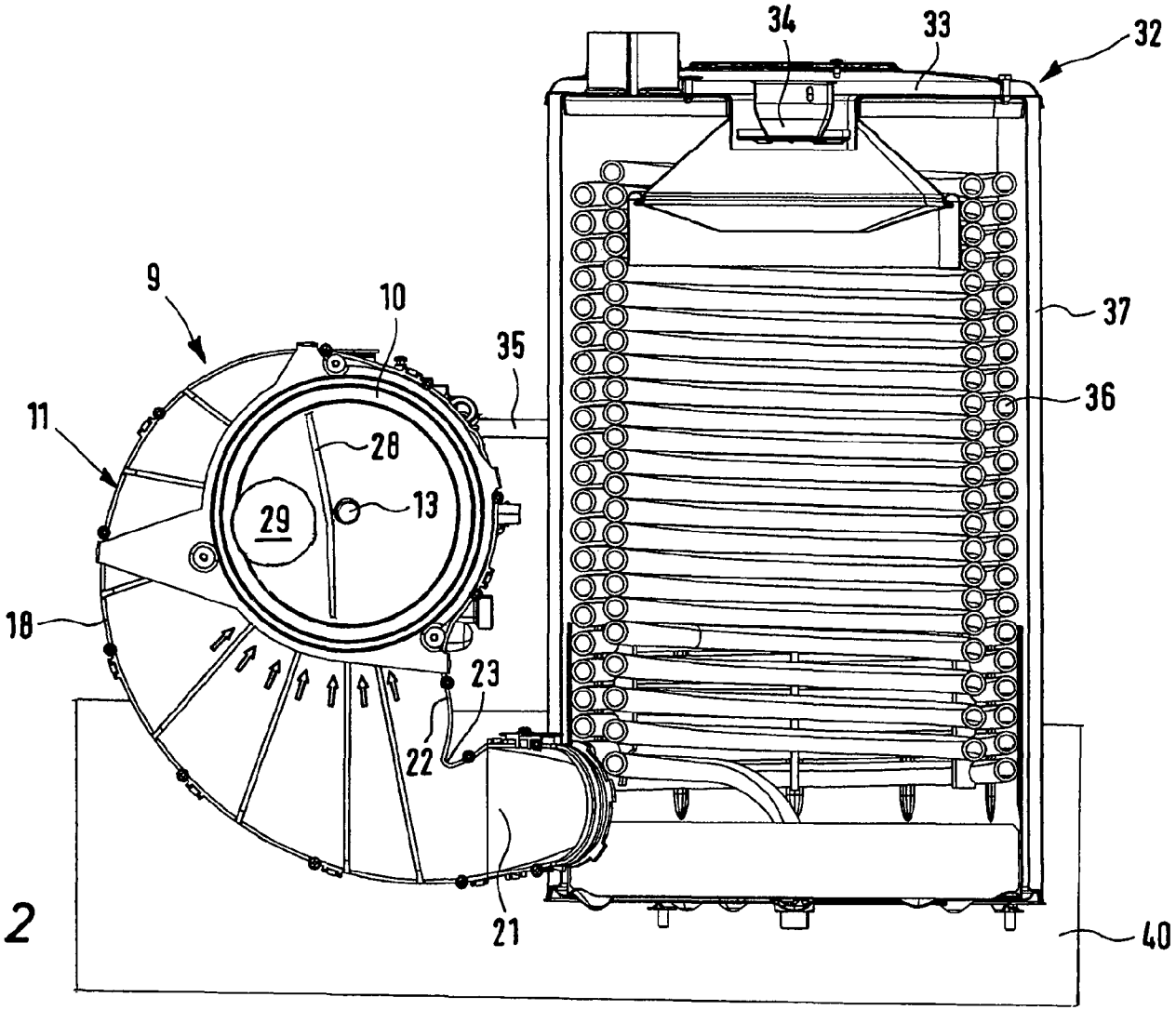
FIG. 2 is a partially cut side view of a high-pressure cleaning apparatus, with a boiler shown in section and the radial fan connected to the boiler being represented as in FIG. 1.
Figure 3:
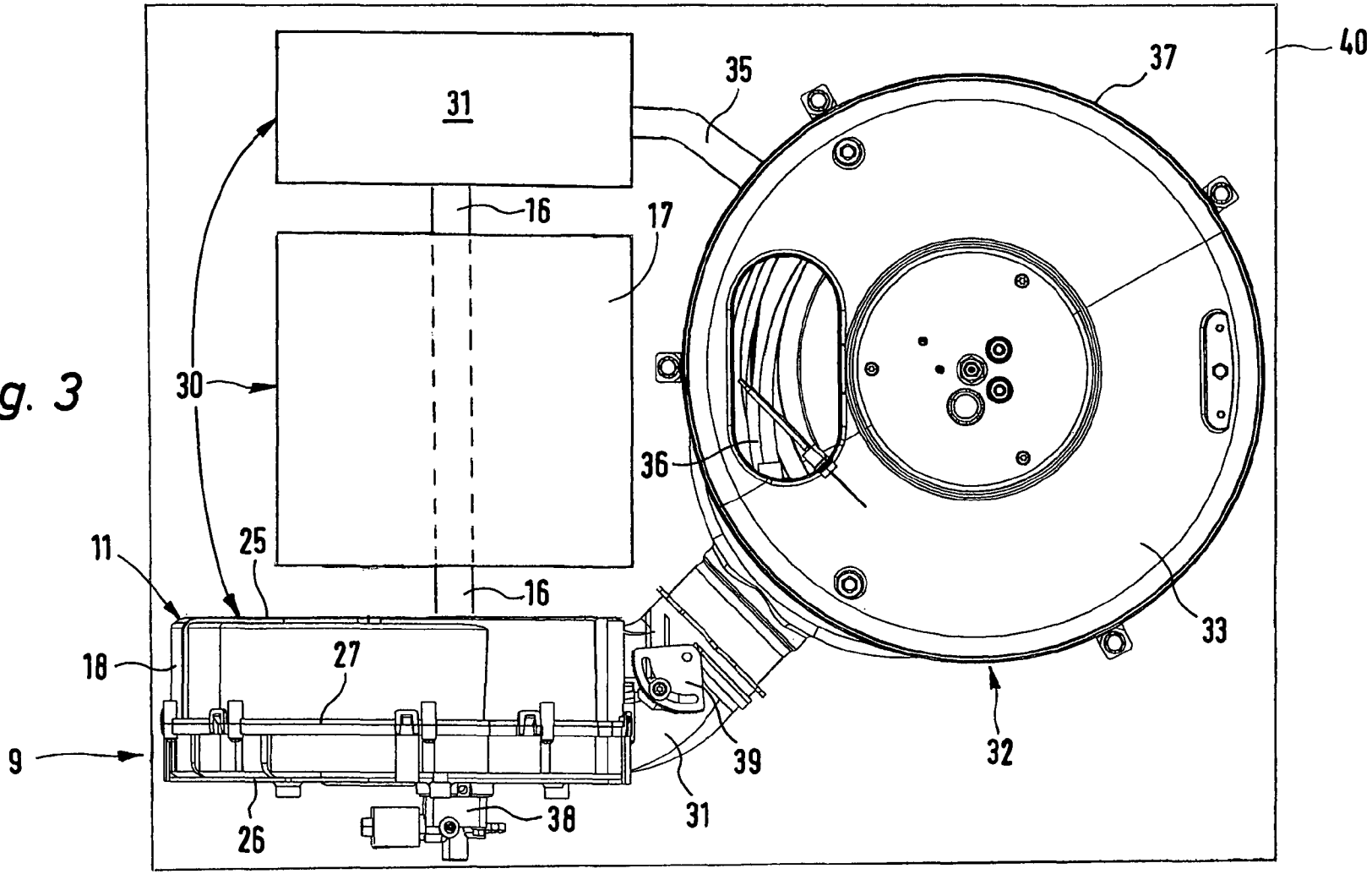
FIG. 3 is a top view of the high-pressure cleaning apparatus with diagrammatic representations of the drive motor and the high-pressure pump.

The high-pressure cleaning apparatus shown in FIGS. 2 and 3 has a structure similar to that of the high-pressure cleaning apparatus known from EP 0248282 B1. The drive motor of the known apparatus has a vertical drive shaft, while the drive shaft 16 of the drive motor 17 according to FIGS. 2 and 3 is horizontal. The high-pressure cleaning apparatus described in the context of the invention may obviously also be designed with a vertical drive shaft 16.

A chassis 40, which may be a mobile chassis provided with wheels, supports a pump and fan assembly 30 with a drive motor 17, the drive shaft 16 of which drives the impeller 10 on one side of the centrifugal fan 9 and a high-pressure pump 31 on the opposite side. The centrifugal fan 9 or its outlet region 21 is connected to a cylindrical boiler 32 the cover 33 of which supports a fan-assisted burner 34 operated with gas or liquid fuel. The high-pressure pump 31 is connected to a tube system 36 in the interior of the boiler 32 via a connecting line 35, the tube system 36 extending along the cylindrical outer wall 37 of the boiler 32 in a plurality of coils. In the illustrated embodiments, these coils are arranged in two layers, but another number of layers can obviously be used.

The air flow generated by the centrifugal fan 9 flows upwards in the boiler 32 along the outer wall 37 and supplies the fan-assisted burner 34 with the required combustion air. The burner flame extends vertically downwards from the fan-assisted burner 34 and heats the tube system 36 and thereby the fluid contained therein. The heated fluid is then pumped in a continuous process by the high-pressure pump 31 to an outlet nozzle not shown in the drawing and usually attached to a high-pressure hose.

A fuel pump 38 for supplying fuel to the fan-assisted burner 34 is connected to the drive shaft 16 or the hub 13 of the impeller 10 at the side of the centrifugal fan 9 and is driven simultaneously.

A regulating element 39 at the discharge of the centrifugal fan 9 or the outlet region 21 regulates the generated air flow in accordance with requirements.

The drive motor 17 is usually a 4-pole asynchronous motor with a 50 Hz alternating current effecting a speed of less than 1500 rpm. In principle, electronically controlled motors can be used, which would allow for a more variable fan speed.

The housing 11 of the centrifugal fan 9 is expediently made of plastic for cost-effective production on one hand and low weight on the other hand. In principle, a metal housing can be used.

The invention claimed is:

1. Centrifugal fan comprising:

a pot-like impeller provided with a blade ring at its circumference, a housing accommodating the impeller, a circumferential wall of said housing, starting from a first circumferential wall region with an arc-like curvature which extends directly along the blade ring, comprises:

in the direction of rotation of the impeller a second circumferential region with a radial distance from the impeller increasing spirally up to an outlet region, and against the direction of rotation of the impeller a third circumferential wall region likewise extending to the outlet region, two side walls covering the axial end faces of the impeller, a partition provided on one of the side walls extending into the pot-shaped impeller and dividing an interior of the impeller into a first suction chamber and a second suction chamber, and wherein the first suction chamber has an intake and the second suction chamber is adjacent to the first circumferential wall region which directly extends along the blade ring, wherein the third circumferential region, starting from the first circumferential region, has an S-curvature towards the outlet region and comprises a sub-region being curved in the same direction as the first circumferential wall region, said sub-region forming a flow baffle element for an air flow returned to the second suction chamber, wherein the outlet region expands in cross-section in the manner of a diffuser in the outlet flow direction, and wherein the third circumferential wall region has a shape oriented towards the interior of the housing in the manner of a tongue at the housing-side start of the outlet region.

2. Centrifugal fan according to claim 1, wherein the end regions of the second and third circumferential wall regions which are remote from the impeller form opposite wall regions of the outlet region.

3. Centrifugal fan according to claim 1, wherein the outlet region has a smallest width with respect to other portions of the outlet region at a housing-side start of the outlet region.

4. Centrifugal fan according to claim 3, wherein the smallest width of the outlet region is less than half of the diameter of the impeller.

5. Centrifugal fan according to claim 1, wherein the housing is made of plastic or metal.

6. Centrifugal fan according to claim 1, wherein the second circumferential wall region has a logarithmic spiral shape.

7. High-pressure cleaning apparatus with a centrifugal fan according to claim 1, wherein the impeller of the centrifugal fan and a high-pressure pump are mounted on one and the same drive shaft of a drive motor and form a pump and fan assembly.

8. High-pressure cleaning apparatus according to claim 7, wherein the centrifugal fan is located on one side of the drive motor and the high-pressure pump is located on the other side of the drive motor.

9. High-pressure cleaning apparatus according to claim 7, wherein the pump and fan assembly is mounted on a mobile chassis together with a boiler, wherein the centrifugal fan is connected to the boiler for supplying combustion air for a burner and wherein a fluid line extends from the high-pressure pump to heat the fluid in the boiler.

* * * * *